United States Patent [19]

Clausen

[11] Patent Number: 4,623,176

[45] Date of Patent: Nov. 18, 1986

[54] FASTENING DEVICE

[76] Inventor: Anthony R. Clausen, 7 Klip Street, Observatory, Johannesburg, Transvaal Province, South Africa

[21] Appl. No.: 533,737

[22] Filed: Sep. 19, 1983

[30] Foreign Application Priority Data

Sep. 21, 1982 [ZA] South Africa ..... 82/6926

[51] Int. Cl.[4] ..... E05C 19/02

[52] U.S. Cl. ..... 292/74; 292/DIG. 53; 292/DIG. 60

[58] Field of Search ..... 292/74, 75, 106, 150, 292/207, DIG. 53, DIG. 60

[56] References Cited

U.S. PATENT DOCUMENTS

| | | | |
|---|---|---|---|
| 1,590,297 | 6/1926 | König | 70/355 |
| 1,937,425 | 11/1933 | Falk | 292/74 X |
| 2,581,606 | 1/1952 | Seaman et al. | 292/74 |
| 4,332,153 | 6/1982 | Miles | 70/355 X |

FOREIGN PATENT DOCUMENTS

| | | |
|---|---|---|
| 198648 | 7/1958 | Austria . |
| 354502 | 3/1921 | Fed. Rep. of Germany . |
| 1553563 | 2/1970 | Fed. Rep. of Germany . |
| 711387 | 10/1931 | France . |
| 778029 | 3/1935 | France . |

*Primary Examiner*—Richard E. Moore

[57] ABSTRACT

A fastening device for a cupboard door, which includes a catch member that is slidable within a carriage, the catch member and the carriage being biassed outwardly by means of springs. A restraining member is displaceable into and out of engagement with the carriage to restrain displacement thereof, and has a projection for restraining it in engagement with the carriage. Both the restraining member and the projection are externally operable. The fastening device also includes a locking means having a bolt slidable in a housing which defines a blocking pin, a tumbler plate having an annular recess and a auxiliary plate having an H-shaped aperture, in which recess and aperture the pin is received. The plates engage the bolt and prevent displacement thereof unless the plates themselves are displaced relative to the pin.

18 Claims, 13 Drawing Figures

FASTENING DEVICE

This invention relates to a fastening device. More particularly, it relates to a fastening device for cupboard doors and the like and may be in the form of a catch, latch or lock.

Fastening devices are currently provided for cupboard doors and the like, which are spring loaded so that the door is kept closed until a predetermined opening force is exerted thereon which is sufficient to overcome the biassing force on a catch member holding the door closed. However, with such known fastening devices, the degree of movement permitted for the catch member in opening and closing the door is limited. With mass production of the cupboards, the tolerances are not sufficiently small enough to enable the fastening devices to be fixed in position on the doors in predetermined positions, and manual adjustment of the positions of the fastening devices on the doors is necessary. This is labour intensive and is correspondingly time-consuming and expensive. It is an object of the present invention to provide a fastening device which may be secured to a door in a predetermined position and is adjustable while secured to the door to thereby minimise the time and work necessary to adjust the fastening device so that it operates correctly.

According to the invention there is provided a fastening device for a cupboard or the like which includes a displaceable catch member;

a first bias means for the catch member; and a stop means for the first bias means, which stop means is adjustable externally of the device.

In one form, the stop means may include a displaceable stop member, and may further include a second bias means for the stop member, which may be weaker than the first bias means. Then the stop means may include a restraining means for restraining displacement of the stop member. The restraining means and the stop member may be restrainable in any one of a number of positions.

It will be appreciated that the fastening device is secured to the door in a predetermined position. The door is then closed. As the second bias means is weaker than the first bias means, the position of the catch member relative to the stop member is maintained and the stop member is displaced a suitable extent. The restraining means is then operated, to restrain the stop member in that particular position. Then, when the door is thereafter opened and closed, the catch member is displaced against its bias means, the stop member remaining in position.

The restraining means may include a restraining member that is displaceable into and out of engagement with the stop member, and the restraining member and the stop the member may have mutually engaging formations.

The restraining member may be displaceable externally of the device. Thus, the restraining member may define engaging formations engageable by an operating member to linearly displace the restraining member. For example, the restraining member may define a rack formation engageable by a rotatable operating member having a suitable gear formation.

The restraining means may have a latch means for retaining it in an operative position, wherein it restrains displacement of the stop member. The latch means may also be operable externally of the fastening device to release the restraining means from its operative position such that it no longer restrains displacement of the stop member. The latch means may comprise a latch projection on the restraining member, which may be engageable with a shoulder formation to retain the restraining member in engagement with the stop member, and the projection may be disengageable from the shoulder formation, externally of the fastening device, in order that the restraining member may be displaced out of engagement with the stop member. Thus, the latch member may define an engaging formation engageable by a tool to displace the latch externally of the device, and thereby release the restraining means.

The fastening device of the invention may include a locking means.

The locking means may include a bolt displaceable into and out of a locking position by means of a suitable key or the like. One or more keyholes may then be provided to permit access for the key to the bolt. Conveniently, the or each keyhole may also provide access to the restraining member to permit displacement thereof externally of the fastening device.

The locking means may comprise a restraining device as hereinafter described.

According to a further aspect of the invention, there is provided a restraining device which includes a displaceable bolt displaceable by means of a key;

a housing having a blocking pin; and a tumbler plate having an annular recess in which the pin is received, the plate being engaged with the bolt to prevent displacement thereof unless the plate itself is suitably displaced relative to the pin.

The annular recess may be substantially rectilinear, or may define a rectilinear central portion which is cooperable with the pin to control displacement of the bolt.

The annular recess may also have corner lobes.

Further, the restraining device may have a further auxiliary plate which has an H-shaped aperture in which the pin is received, the auxiliary plate also being engaged with the bolt to control displacement thereof. It will be appreciated that the tumbler plate and the auxiliary plate are suitably displaced by cuts and projections on the bit of a key associated therewith, to be correctly displaced so that they are displaceable together with the bolt, with the pin then negotiating a suitable path along the aperture in the auxiliary plate or the recess in the tumbler plate. The bolt may have a slideway in which the tumbler plate and the auxiliary plate are received, to be displaceable in a direction transverse to the direction of movement of the bolt in use, in order to allow the auxiliary plate and the tumbler plate to move longitudinally together with the bolt.

The tumbler plate and the auxiliary plate may have spring portions which keep them centred in the slideway.

The restraining device may also have a deadlock function, the bolt and its housing having suitable constraining formations to constrain the bolt in either its extended or retracted position.

The restraining device according to the invention may be incorporated as the locking means for the fastening device as hereinabove described.

The restraining device, the fastening device, and the components thereof may be of metal, or of a suitable synthetic plastics material, which may conveniently be moulded.

The invention is now described by way of examples, with reference to the accompanying drawings, in which.

Figure 1:
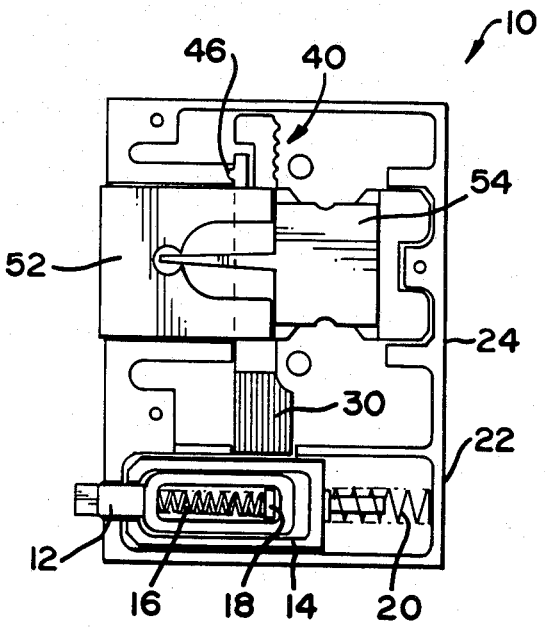
FIG. 1 shows a view of a first embodiment of a fastening device in accordance with the invention from one side.

Referring to FIGS. 1 to 5, a first embodiment of a fastening device in accordance with the invention is shown generally by reference numeral 10. The fastening device 10 has a linearly displaceable catch member 12 that is slidable within a carriage 14. The catch member 12 is biassed outwardly by means of a spring 16 that engages a projection 18 of the carriage 14. The carriage 14, in turn, is biassed outwardly by means of a further spring 20 which engages the carriage 14 and a wall portion 22 of a housing member 24. On the underside of the carriage 14 there are a number of riffles 26 the purpose of which will be explained below.

The fastening device 10 also has a restraining member 28 that is linearly displaceable in a direction transverse to the direction of movement of the catch member 12 and the carriage 14. The restraining member 28, at its lower end adjacent the carriage 14 also has riffles 30 which are engageable with the riffles 26 on the carriage 14. It will accordingly be appreciated that, in use, the fastening device 10 is secured to a door 29 for closing an aperture defined by spaced wall portions 31 of a cupboard for example. The fastening device 20 is secured to the door 29 in a predetermined position. The door is closed causing the catch member 12 and the carriage 14 to be displaced. When the catch member 12 projects outwardly from the door 29 to an extent that the door 29 is not closable, the catch member 12 is manually displaced inwardly until the door 29 can be closed. Once the door 29 is closed, the catch member 12 is urged outwardly again a sufficient distance for the catch member 12 to engage the adjacent wall portion 31, or an engaging formation provided on or defined by the said wall portion 31. In FIG. 3 the catch member engages a recess 33 in the wall portion 31. As the spring 16 is substantially stronger than the spring 20, the relative positions of the catch member 12 and carriage 14 are maintained whilst the carriage 14 is displaced into the housing 24. The restraining member 28 is then displaced from the position shown in FIG. 2 to the position shown in FIG. 3 to thereby lock the carriage 14 in the position that it has adopted. The restraining member 28 is displaced, using a suitable tool, externally of the door as will be explained below. With the carriage locked in this position, the catch member 12 is then in the correct position for it to operate correctly when the door is opened and closed.

Figure 4:
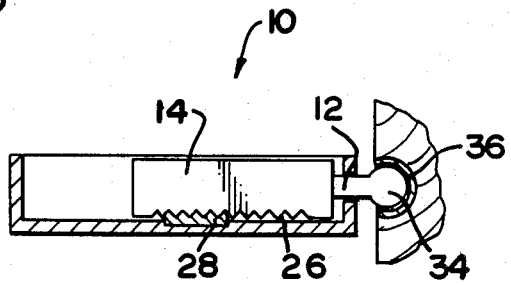
FIG. 4 shows a sectional view along line IV—IV in FIG. 3.

As shown in FIG. 4, the catch member 12 has a rounded head portion 34 with a part-cylindrical swivel member 36 mounted thereon. The swivel member 36 is able to swivel about the head 34, thereby facilitating displacement of the catch member 12 when the door is opened and closed.

Figure 2:
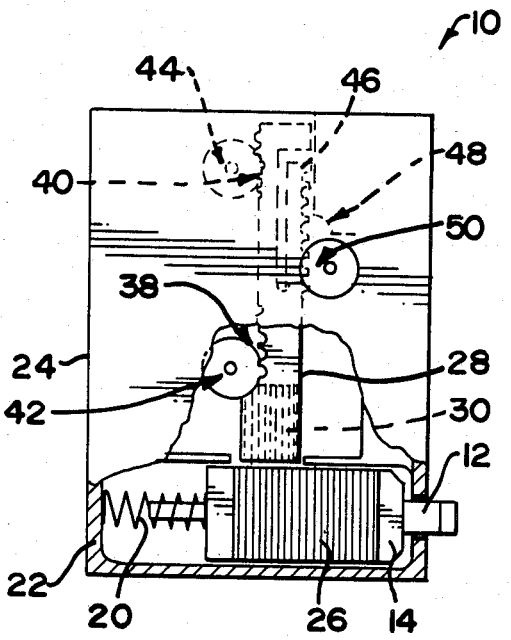
FIG. 2 shows a partly sectioned view of the fastening device from the other side, with the stop member and the restraining member thereof disengaged.
Figure 3:
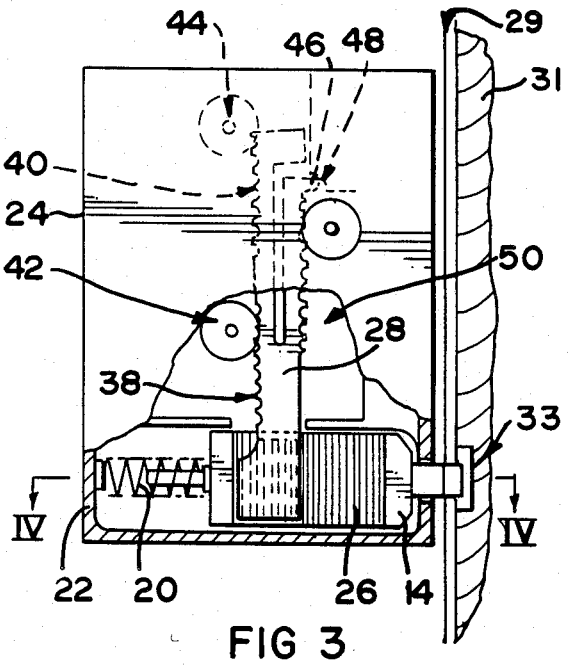
FIG. 3 shows a view similar to that of FIG. 2, with the restraining member and the stop member engaged with one another.

As will be seen in FIGS. 1, 2 and 3, the restraining member 28 has two rack formations 38 and 40. These rack formations 38 and 40 are accessible via keyhole openings 42 and 44. It will thus be understood that the restraining member 28 may be displaced into engagement with the carriage 14 by means of a rotatable tool having a pinion formation at its end which is engageable wih the rack formations 38 or 40.

Further, the restraining member 28 has a latch projection 46 which is engageable with a shoulder formation 48, as shown in FIG. 3, to lock the restraining member 28 in engagement with the carriage 14.

To provide that the restraining member 28 may be displaced out of engagement with the carriage 14, the latch projection 46 of FIG. 3 is provided with a further rack formation 50 which is engageable with the tool referred to above to displace the restraining member 28. Although not clearly shown in the drawings, the rack portion 50 is curved at its end close to the projection 46 so that when the tool is engaged with the rack 50, the projection 46 is displaced out of engagement with the shoulder formation 40.

Figure 5:
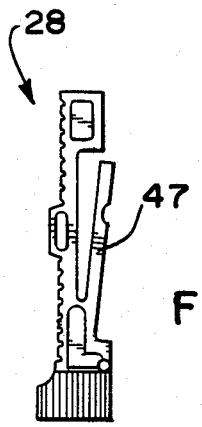
FIG. 5 shows a further embodiment of a restraining member for the fastening device of FIGS. 1 to 3.
Figure 6A:
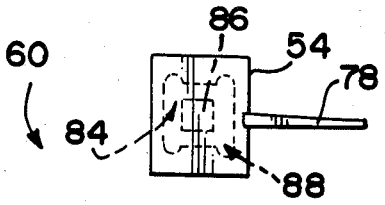
FIGS. 6A to 6D show various components of a second embodiment of a fastening device in accordance with the invention.
Figure 6B:
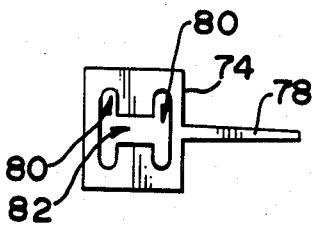
Figure 6C:
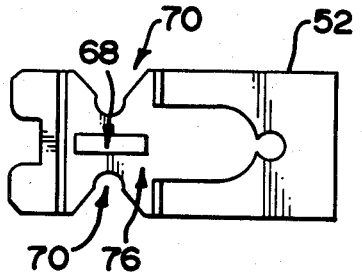
Figure 6D:
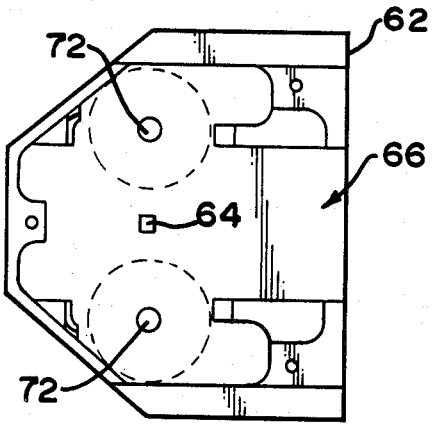
Figure 7:
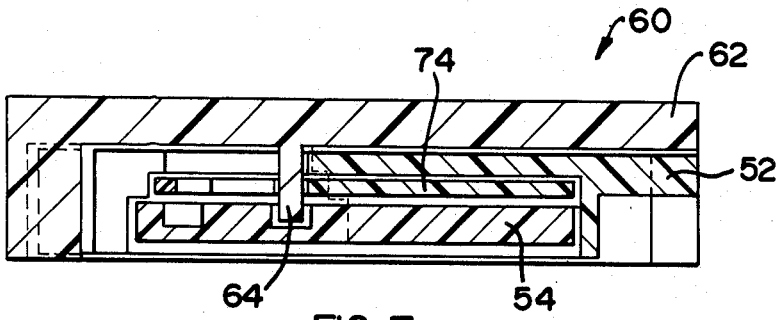
FIG. 7 shows a sectional view of the second embodiment of the fastening device.
Figure 8:
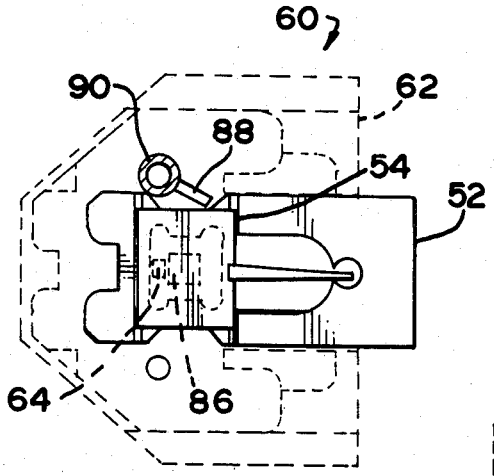
FIGS. 8, 9 and 10 show schematically how the second embodiment of the fastening device operates.
Figure 9:
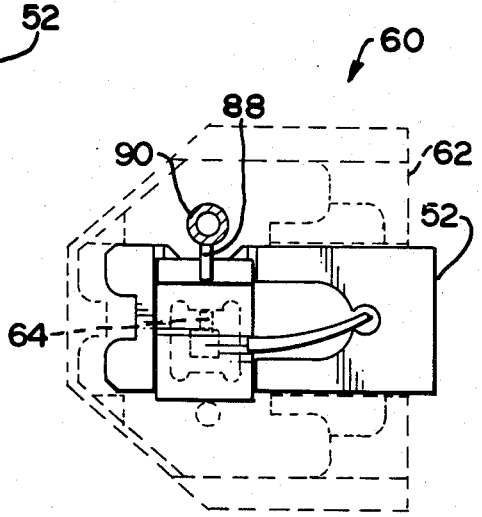
Figure 10:
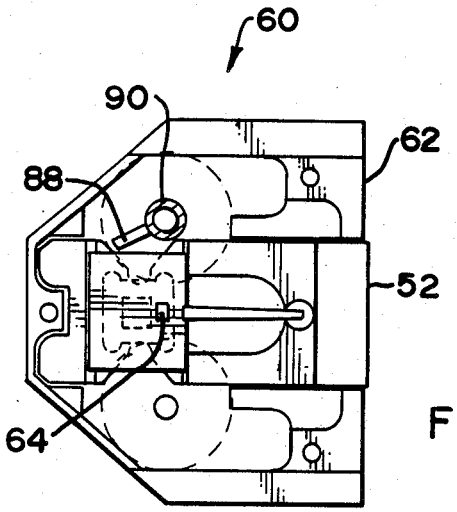

Instead of the latch projection 46, as shown in FIG. 3, a latch projection 47 as shown in FIG. 5 may be used. The latch projection 47 is displaceable in a direction towards the restraining member 28 and engageable by a small, screwdriver-like tool to urge it towards the restraining member and thereby displace it out of engagement with the shoulder formation 40. The latch projection 47 may define an engaging surface which is inclined at an angle of 45° or so to the direction of engagement of the tool to facilitate displacement of the projection 47 thereby. While the latch projection 47 is being held out of engagement with the shoulder formation 40 by means of the said small tool, the restraining member 28 is displaceable out of engagement with the carriage 14 in the same manner that it is displaceable into engagement with the carriage 14. That is, while the latch projection 47 is being held out of engagement with the shoulder formation 40, the rotatable tool having a pinion formation at its end is engageable with the rack formation 38 or 40 via keyhole openings 42 or 44 thereby to displace the restraining member 28 out of engagement with the carriage 14.

The latch projection 47 has an advantage over the latch projection 46 that only a very small opening is required in the housing member 24 to provide access for the simple tool, whereas a much larger opening is required in the housing 24 to accommodate the rotatable tool with the pinion formation at its end.

Referring further to FIG. 1, the fastening device 10 also provides a lock function as it has a bolt 52 that is displaceable into and out of the housing 24 by means of a suitable key (not shown). The bolt 52 is engaged with a tumbler plate 54. The bolt 52 and tumbler plate 54 of the fastening device 10 shown in FIG. 1 are similar to the bolt and tumbler plate of the fastening device shown in FIGS. 5 to 9 and the construction and operation of the bolt 52 and 54 will accordingly be discussed with reference to these drawings, below.

Reference is now made to FIGS. 5 to 9, in which a further embodiment of a fastening device in accordance with the invention is designated generally by reference numeral 60. The fastening device 60 has a housing member 62 which has a pin 64. The housing member 62 also has a slideway 66 in which a bolt 52 (which is similar to the bolt 52 in the previous embodiment and is accordingly similarly referenced) is received. The bolt 52 has a slot 68 through which the pin 64 passes. The bolt 52 also has recesses 70 which co-operate with a bit 88 of a key 90 (shown in FIGS. 7 to 9) to move the bolt 52 back and forth. The housing member 62 has further pins 72 which locate the key 90, there being suitable keyhole openings in a closure plate (not shown) for the housing member 62.

Movement of the bolt 52 is controlled by means of a tumbler plate 54 and an auxiliary plate 74. The bolt 52 has a slideway 76 in which the auxiliary plate 74 and tumbler plate 54 are received, to be displaceable in a direction transverse to the direction of movement of the bolt 52. The tumbler plate 54 and auxiliary plate 74 has an H-shaped aperture having two legs 80 and a cross-portion 82. The tumbler plate 54 in turn has a square annular recess 84 defined about a central square projection 86 and also has corner lobes 88. When assembled, as shown in FIG. 6, the pin 64 passes through the slot 68 in the bolt 52, through the aperture in the auxiliary plate 74 and into the annular recess 84 in the tumbler plate 54. When the auxiliary plate 74 and tumbler plate 54 are in their normal central position, and the bolt is either fully extended or fully retracted, the pin 64 is located in one of the legs 80 adjacent the central portion 82 and on one side or other of the projection 86 in the tumbler plate 54. It will be appreciated, that it is not possible to slide the bolt 52 in or out, when in this configuration, as the pin 64 engages the projection 86.

It will further be understood, that in order to move the bolt 52 in or out it is necessary to displace the tumbler plate 54 laterally so that the pin 64 clears the projection 86. This is accomplished by a projection on the bit 88 of the key 90. It will further be appreciated, that if the projection is not the correct size, the tumbler plate 54 will either be displaced too far (in which case the pin 64 will enter one of the lobes 88) or not far enough (in which case the projection 84 will still engage the pin 64). In either case, the bolt 52 will be locked and the key 90 will not turn.

Similarly, the auxiliary plate 74 co-operates with a cut in the bit 88. If the cut 88 is the right size, the auxiliary plate 74 is not laterally displaced, so that the pin 64 is able to pass along the cross-portion 82 as the bolt 52 and accordingly the auxiliary plate 74 are displaced upon turning of the key 90. If the cut is the wrong size, then the auxiliary plate 74 will be displaced laterally so that the pin 64 moves along one of the legs 80 and movement of the auxiliary plate 74 and correspondingly the bolt 52 is impeded.

By means of the invention a cheap, multi-function catch or lock is provided for doors and the like, which is cheap and easy to manufacture and install and yet reliable and robust in operation.

I claim:

1. A fastening device for a door for a cupboard or the like, which includes a support member securable to the door at a suitable desired position;

a stop means that is adjustably mounted on the support member and comprises a stop member and a displacement limiting means fast with the stop member;

a catch member which is mounted on the stop member to be displaceable with respect thereto between an extended position in which it extends past the support member to be engageable with the jamb of the door, and a retracted position in which it does not thus extend past the support member, the extent of its displacement from the stop member being limited by the displacement limiting means;

a first bias means carried by the stop member for biassing the catch member from the stop member towards its extended position; and a restraining member that is mounted on the support member to be displaceable between a restraining position in which it engages the stop means and restrains displacement thereof with respect to the support member, and a non-restraining position in which the stop means and the catch member are displaceable together, the restraining member being engageable via an opening in the door by an operating tool from outside the device, and whereby the restraining member is displaceable into restraining engagement with the stop means when it is in a desired position with the catch member projecting beyond the support member a desired extend when it is at the limit of its displacement from the stop member.

2. A fastening device as claimed in claim 1, wherein the stop means is displaceable with respect to the support member, and which includes a second bias means carried by the support member for biassing the stop member towards the catch member.

3. A fastening device as claimed in claim 2, wherein the second bias means is weaker than the first bias means.

4. A fastening device as claimed in claim 1, wherein the restraining member and the stop means have mutually engaging formations.

5. A fastening device as claimed in claim 1, wherein the restraining member has a rack formation engageable by a suitable pinion formation on the operating tool whereby it is linearly displaceable into and out of restraining engagement with the stop means.

6. A fastening device as claimed in claim 1, wherein the restraining member has a latch formation engageable with a retaining formation on the support member to retain the restraining member in restraining engagement with the stop means.

7. A fastening device as claimed in claim 6, wherein the latch formation is positionally adjustable externally of the fastening device to disengage it from the retaining formation such that it no longer retains the restraining member in restraining engagement with the stop means.

8. A fastening device as claimed in claim 6, wherein the latch formation comprises a latch projection on the restraining member.

9. A fastening device as claimed in claim 8, wherein the latch formation defines an engaging formation engageable by a tool to facilitate positional adjustment of the latch formation externally of the device, thereby to release the restraining member.

10. A fastening device as claimed in claim 1, which includes a locking means having a bolt which is mounted on the support member and is positionally adjustable by means of a key from outside the device, such that the bolt is displaceable with respect to the support member between an extended, locked position and a retracted, inoperative position.

11. A fastening device as claimed in claim 10, wherein the locking means comprises the said bolt which is displaceable with respect to the support member;

a blocking pin fast with the support member; and a tumbler plate having an annular recess in which the pin is received, the plate being engaged with the bolt to prevent displacement of the bolt independently of the plate and relative to the pin.

12. A fastening device as claimed in claim 11, wherein the annular recess is substantially rectilinear and defines a rectilinear central portion which is co-operable with the pin to control displacement of the bolt.

13. A fastening device as claimed in claim 11, wherein the annular recess has corner lobes.

14. A fastening device as claimed in claim 11, wherein the locking means includes an auxiliary plate which has an H-shaped aperture in which the pin is received, and which also engages the bolt to further control the displacement thereof.

15. A fastening device as claimed in claim 14, wherein the bolt has a slideway in which the tumbler plate and the auxiliary plate are received, to be displaceable in a direction transverse to the direction of movement of the bolt in use.

16. A fastening device as claimed in claim 15, wherein the tumbler plate and auxiliary plate have spring portions which keep them centred in the slideway when the bolt occupies either its extended or retracted position.

17. A fastening device as claimed in claim 11, wherein the support member and the tumbler plate have interengageable constraining formations to constrain the bolt in either its extended or retracted position.

18. A fastening device as claimed in claim 17, wherein the pin of the support member and the rectilinear central portion of the tumbler plate constitute the constraining formations.

* * * * *